US006911956B2

(12) United States Patent
Miyata

(10) Patent No.: US 6,911,956 B2
(45) Date of Patent: Jun. 28, 2005

(54) ARRAY ANTENNA

(75) Inventor: Katumasa Miyata, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 7 days.

(21) Appl. No.: 10/481,731

(22) PCT Filed: Sep. 20, 2002

(86) PCT No.: PCT/JP02/09731

§ 371 (c)(1),
(2), (4) Date: Dec. 22, 2003

(87) PCT Pub. No.: WO03/096479

PCT Pub. Date: Nov. 20, 2003

(65) Prior Publication Data

US 2004/0174315 A1 Sep. 9, 2004

(30) Foreign Application Priority Data

May 10, 2002 (JP) ..... 2002-135773

(51) Int. Cl.[7] ..... H01Q 15/08
(52) U.S. Cl. ..... 343/911 R; 343/909; 343/771

(58) Field of Search ..... 343/753, 754, 343/756, 770, 771, 909, 911 R

(56) References Cited

U.S. PATENT DOCUMENTS 5,173,714 A * 12/1992 Arimura et al. ..... 343/771
5,929,819 A * 7/1999 Grinberg ..... 343/754

* cited by examiner

*Primary Examiner*—Hoang V. Nguyen
(74) *Attorney, Agent, or Firm*—Fattibene & Fattibene; Paul A. Fattibene; Arthur T. Fattibene

(57) ABSTRACT

Dielectric lenses (6) with an outer dimension of about 0.5 to 1.5 times a wavelength are arranged on front faces of respective slots (3) of a waveguide slot array antenna (1). The dielectric lenses (6) are formed in a panel structure where they have been connected integrally through a dielectric panel (7) so that they cover a front face of the antenna. Spherical waves radiated from the slots are converted into a flat wave by the dielectric lenses, and a composite wave of radiation waves from the respective slots becomes a flat wave which hardly includes ripples, so that an antenna gain is remarkably improved as compared with a case that dielectric lenses are not provided.

4 Claims, 4 Drawing Sheets

ARRAY ANTENNA

TECHNICAL FIELD

The present invention relates to an array antenna, and in particular to an array antenna whose gain has been improved.

BACKGROUND ART

As an antenna mainly used in a frequency band of a microwave or higher, an array antenna where many radiation elements are arranged in a row or in a matrix manner and they are connected by a microstrip transmission line and an array antenna where microwave radiation slots are formed on a waveguide wall at constant intervals have been known. Such an array antenna is constituted so as to achieve improvement in gain by radiating electric waves from a plurality of radiation elements or slots. However, in a flat wave composed of spherical waves radiated from respective radiation elements or slots, there is undulation of a phase on a flat plane perpendicular to a radiation directivity axis and the ripples adversely affects a gain, which results in a tendency that the gain does not increase proportionally to the number of radiation elements or slots.

In view of the above circumstances, a technical problem to be solved occurs in order to reduce a ripple of radiation waves of the array antenna to improve the gain, and an object of the present invention is to solve the above problem.

DISCLOSURE OF THE INVENTION

The present invention has been proposed in order to achieve the above problem, and provides an array antenna where a plurality of radiation elements or radiation slots are arranged in a parallel manner, wherein a plurality of dielectric lenses with an outer dimension of about 0.5 to 1.5 times a wavelength are arranged over a whole surface of a radiation face.

The present invention provides an array antenna where the plurality of dielectric lenses are individually arranged on front faces of the respective radiation elements or the respective radiation slots, and an array antenna where conductor patches are mounted on the plurality of dielectric lenses in a superimposing manner thereon.

Further, the present invention provides an array antenna where, by connecting the plurality of dielectric lenses through a dielectric plate, a group of the dielectric lenses are formed in a integral panel constitution to cover the radiation face.

BEST MODE FOR CARRING OUT THE INVENTION

Figure 1:
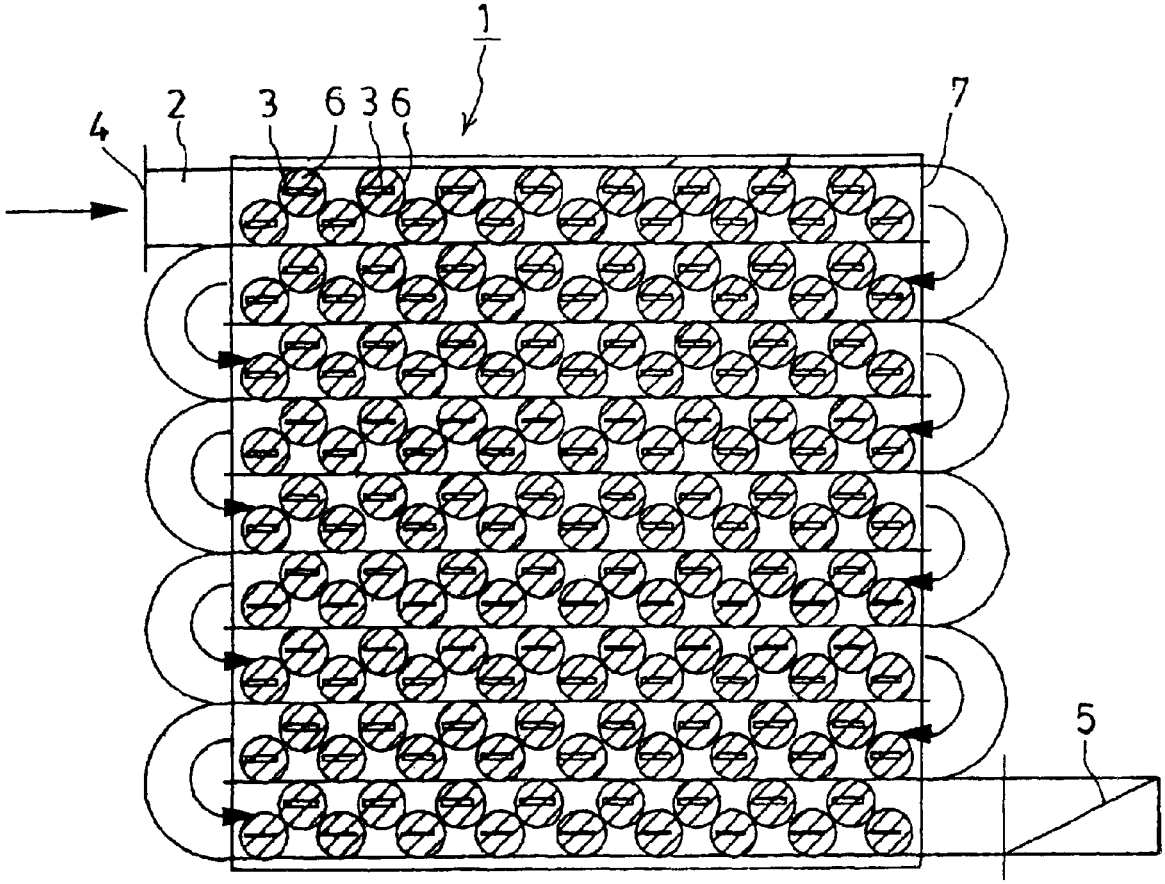
FIG. 1 shows an embodiment and is a front view of a waveguide slot array antenna of a flat type.
Figure 2:
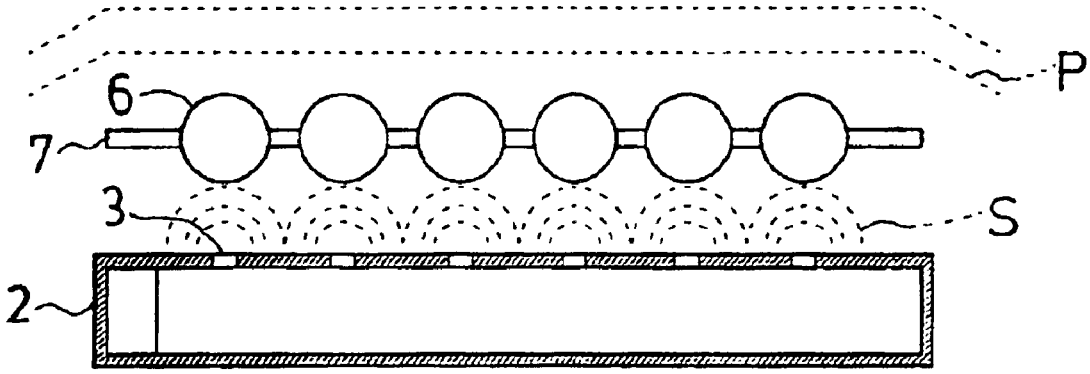
FIG. 2 is a view for explaining a structure of the waveguide slot array antenna of a flat type.

An embodiment of the present invention will be explained below in detail. FIG. 1 and FIG. 2 show a waveguide slot array antenna 1, which constitute a flat antenna having many slots 3 formed on a surface of a waveguide 2 of a 180° multi-stage folding type. The slots 3 are arranged in an matrix manner at constant intervals, and a microwave incident on an opening 4 positioned at a left side upper portion of the waveguide 2 is radiated from the respective slots 3 in this side direction on the drawing while propagating in the waveguide 2, and the remaining energy is absorbed at an anti-reflection terminal end 5.

Dielectric lenses 6 of the same number as the number of slots 3 are opposed to a front face of the waveguide 2 in a one to one positional relationship with the respective slots 3. These dielectric lenses 6 are connected in an integral body through a dielectric panel 7, as shown in FIG. 2, and the dielectric panel 7 covers the front face of the waveguide 2. As well known, the dielectric lens 6 has a lens action converging electromagnetic waves which pass through the dielectric lens 6. Here, spherical waves s are converted in a flat wave p by using the dielectric lens 6 whose outer dimension is in a range of about 0.5 to 1.5 times a wavelength. Thereby, ripples occurring as the composite result of spherical waves s radiated from the respective slots 3 are cancelled and a pure flat wave p is formed, so that a gain of the whole antenna is remarkably improved. Incidentally, the shape of the dielectric lens 6 may be spherical, semi-spherical, conical or the like. Further, integration may be conducted by fitting dielectric lenses in a dielectric panel formed with lens fitting holes, or the dielectric lenses 6 and the dielectric panel 7 may be formed in an integral manner. Then, by employing an integral structure where a plurality of dielectric lenses 6 are thus arranged in the dielectric panel 7 in a distributed manner, such a practical effect that a surface of the waveguide 2 is protected by the dielectric panel 7 can be achieved.

Figure 3:
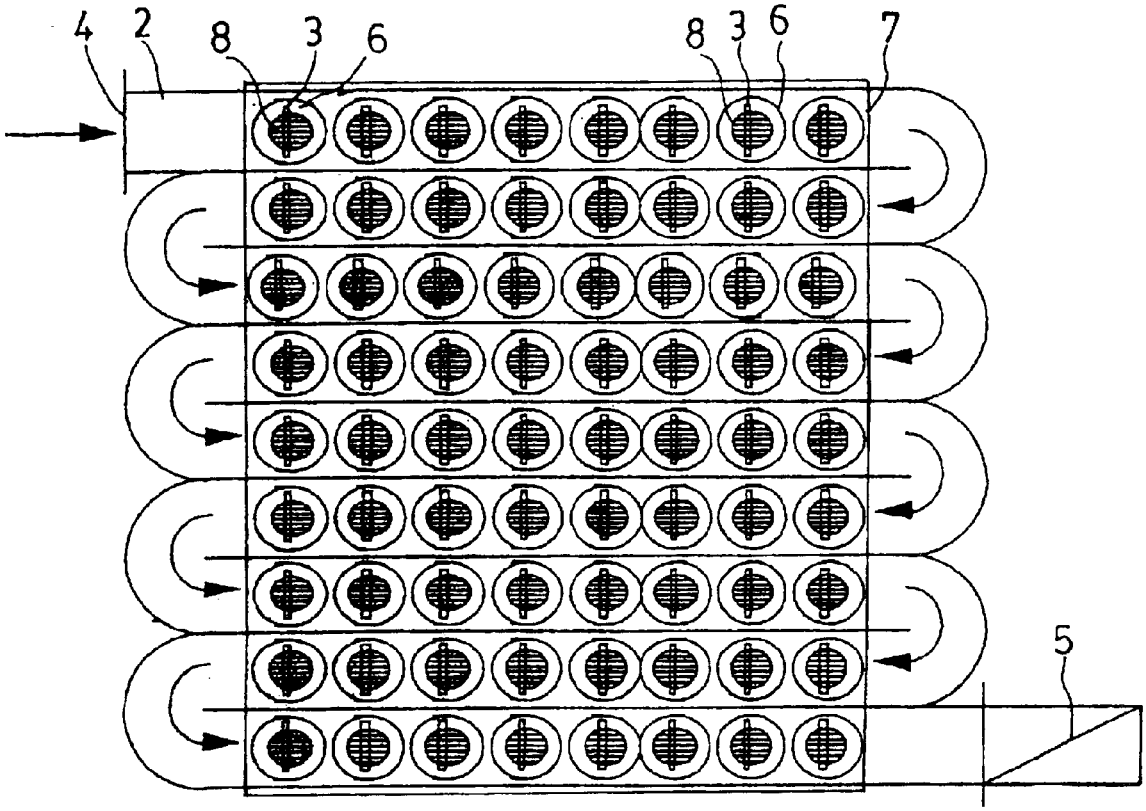
FIG. 3 shows another embodiment and is a front view of a waveguide slot array antenna of a flat type.
Figure 4:
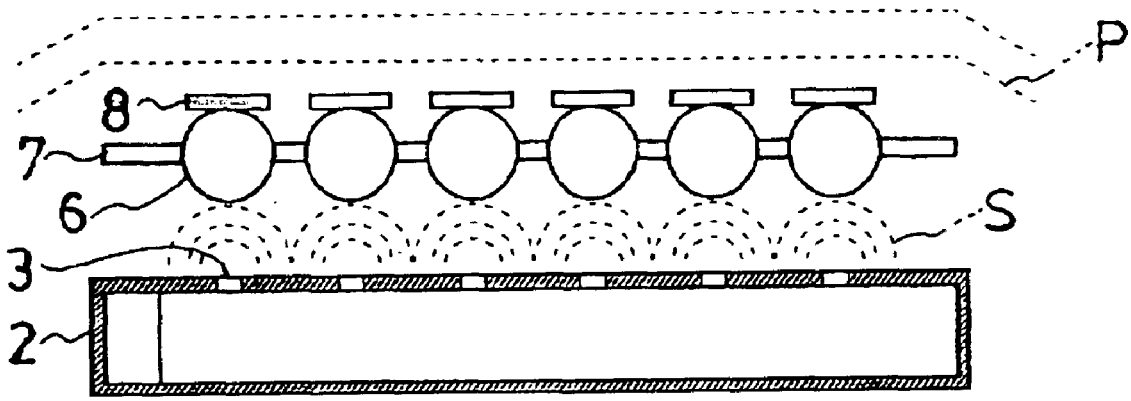
FIG. 4 is a view for explaining a structure of the waveguide slot array antenna of a flat type.

FIG. 3 and FIG. 4 show another embodiment, where conductor patches 8 (for example, conductor plates having a circular shape, a oval shape, or the like) are further mounted to respective dielectric lenses 6 arranged on slots 3 of a waveguide 2 of a flat type. The conductor patch 8 serves to divide an electromagnetic wave which passed through the dielectric lens 6 into wave pieces, and an effect where ripples of the whole antenna are further improved as compared with a case that only the dielectric lenses 6 are used can be achieved by appropriately setting an outer shape and a size of the conductor patch so as to coincide with a frequency. Incidentally, the arrangement aspects of slots 3 in FIG. 3 and FIG. 1 are different from each other, but the mounting effect of the dielectric lenses 6 and the conductor patches 8 does not vary even in any case.

In the above-described embodiments, the example of the array antenna where slots 3 are arranged in the parallel manner in the waveguide 2 has been described. However, a flat wave composition effect similar to the above can be achieved by covering a surface of a micro-strip line shape array antenna where a plurality of radiation elements have been arranged with a plurality of dielectric lenses. Further, instead of such a constitution that the dielectric lenses 6 are individually arranged so as to have a one to one positional relationship with the slots 3 in the waveguide 2, such a constitution can be employed that one dielectric lens is caused to correspond to each plural slots or each plural radiation elements.

Incidentally, the present invention is not limited to the above-described embodiments, but it may be modified variously within the technical range of the present invention, and it is a matter of course that the present invention includes these modifications.

INDUSTRIAL APPLICABILITY

As explained above, in the array antenna of the present invention, since a plurality of dielectric lenses are arranged on a radiation face of the array antenna and ripples of a composite wave of spherical waves radiated from a plurality of slots or radiation elements are removed so that the composite wave is shaped to a flat wave, an antenna gain is remarkably improved. Further, by mounting conductor patches with an appropriate size to the dielectric lenses in a superimposed manner thereon, an ripple removing effect is further improved. Moreover, by forming the group of the dielectric lenses in an integral panel configuration, a surface of the antenna is protected so that weather resistance and dust proof are improved.

What is claimed is:

1. An array antenna where a plurality of radiation elements or radiation slots are arranged in a parallel manner, wherein a plurality of dielectric lenses with an outer dimension of about 0.5 to 1.5 times a wavelength are arranged over a whole surface of a radiation face.

2. The array antenna according to claim 1, wherein the plurality of dielectric lenses are individually arranged on front faces of the respective radiation elements or the respective radiation slots.

3. The array antenna according to claim 1 or 2, wherein conductor patches are mounted on the plurality of dielectric lenses in a superimposing manner therewith.

4. The array antenna according to claim 1, 2 or 3, wherein, by connecting the plurality of dielectric lenses through a dielectric flat plate, a group of the dielectric lenses are formed in an integral panel constitution to cover the radiation face.

* * * * *

UNITED STATES PATENT AND TRADEMARK OFFICE

CERTIFICATE OF CORRECTION

PATENT NO. : 6,911,956 B2 
DATED : June 28, 2005
INVENTOR(S) : Katsumasa Miyata, Hirokazu Awa and Nobuo Tamura It is certified that error appears in the above-identified patent and that said Letters Patent is hereby corrected as shown below:

Title page,
Item [75], Inventor, "Katumasa Miyata, Akita (JP)" should read -- Katsumasa Miyata, Akita (JP), Hirokazu Awa, Akita (JP), and Nobuo Tamura, Akita (JP) --.
Item [73], Assignee, "Mitsumi Electric Co., Ltd., Tokyo (JP)" should read -- Mitsumi Electric Co., Ltd., Tokyo (JP) and Katsumasa Miyata, Akita (JP) --.

Signed and Sealed this

Thirtieth Day of August, 2005

JON W. DUDAS
*Director of the United States Patent and Trademark Office*